United States Patent [19]

Lipschitz

[11] Patent Number: 4,514,349

[45] Date of Patent: Apr. 30, 1985

[54] METHOD AND MEANS FOR PRODUCING YARN

[76] Inventor: Barry Lipschitz, P.O. Box 77, Atlantis, South Africa

[21] Appl. No.: 491,903

[22] Filed: May 5, 1983

[51] Int. Cl.[3] ..... D02G 1/20

[52] U.S. Cl. ..... 264/103; 57/5; 425/73

[58] Field of Search ..... 164/103; 57/5; 425/73–75

[56] References Cited

U.S. PATENT DOCUMENTS

| | | | |
|---|---|---|---|
| 3,358,322 | 12/1967 | Woodberg | 425/75 |
| 3,582,432 | 6/1971 | Havens | 425/75 |
| 3,844,097 | 10/1974 | Bobkowicz et al. | 264/103 |
| 3,924,396 | 12/1975 | Bobkowicz et al. | 264/103 |
| 3,959,055 | 5/1976 | Slanik | 156/167 |
| 3,987,612 | 10/1976 | Bobkowicz et al. | 264/103 |
| 4,154,561 | 5/1979 | Virtanea | 425/73 |
| 4,184,824 | 1/1980 | Swaseg et al. | 425/75 |

FOREIGN PATENT DOCUMENTS

| | | |
|---|---|---|
| 747101 | 11/1966 | Canada . |
| 847099 | 7/1970 | Canada . |
| 983694 | 2/1976 | Canada . |

*Primary Examiner*—Jay H. Woo
*Assistant Examiner*—J. Fortenberry
*Attorney, Agent, or Firm*—Thomas J. Morgan

[57] ABSTRACT

The manufacture of yarn is disclosed by a machine which coats a filament with synthetic plastics material and then applies discrete textile fibres to the tacky layer. The fibres are obtained by tearing a sliver using toothed wheels. All those parts of the machine which are not essentially in the same environment as the wheels are on the opposite side of partitioning to the wheels. Thus the parts which are separated from the wheels by the partitioning are in a substantially fibre free atmosphere, and can be in a closed, pressurized room thus minimising the flow of fibres to these parts.

3 Claims, 3 Drawing Figures

Figure 1:
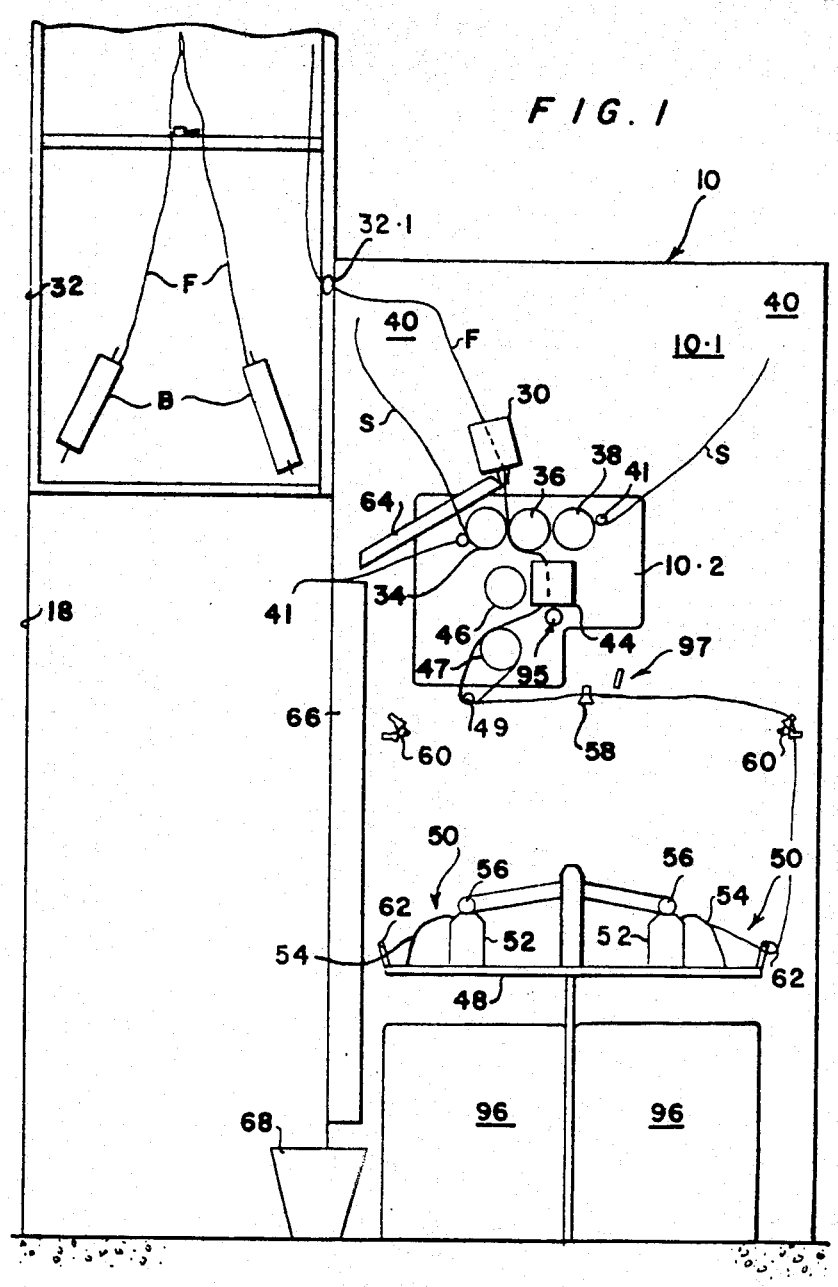

10
32·1
32
F
B
40
F
10·1
40
30
S
S
38
41
36
64
10·2
34
41
18
46
44
97
47
95
66
49
60
58
60
50
56
56
50
62
54
54
52
52
62
48
96
96
68

METHOD AND MEANS FOR PRODUCING YARN

This invention relates to a method and machine for producing yarn.

According to one aspect of the present invention there is provided a method of producing yarn in which a filament is coated with a tacky layer of synthetic plastics material and discrete staple fibres are then applied to the coated filament by machinery comprising some parts which necessarily have to be in a staple fibre containing environment and other parts which do not, which method comprises partitioning the factory space so as to provide a first region and a second region, said some parts being in the first region and said other parts being in the second region, and the partitioning minimising transmission of fibres from said first region to said second region.

The method can include the step of maintaining a pressure differential across the partitioning, the pressure in said first region being lower than that in said second region.

According to a further aspect of the present invention there is provided a factory layout including partitioning and a machine for producing yarn which machine comprises a die head, means for feeding a filament to the die head so that it is coated with a tacky layer of synthetic plastics material, means for applying discrete staple fibres to said tacky layer, drive means for driving the staple fibre applying means, transmission means connecting the drive means and the fibre applying means, said drive means being on one side of said partitioning and the applying means being on the other side of said partitioning with the transmission means passing through the partitioning, said partitioning isolating a first part of the factory space containing the applying means from a second part of the factory space containing the drive means.

It is preferred that said second part be in the form of a closed room with pump means for raising the pressure in said second part to above the level of that in the first part.

According to another aspect of the present invention there is provided a machine for producing yarn which comprises a single die head, an extruder structure for extruding synthetic plastics material and including a barrel and a screw, the extruder structure being connected to the die head, means for feeding a filament to the die head so that it is coated with a tacky layer of synthetic plastics material, and means for applying discrete staple fibres to said tacky layer, characterized in that the material extruded by the extruder structure is fed exclusively to said single die head.

According to yet another aspect of the present invention there is provided a yarn producing facility comprising at least two machines for producing yarn, each machine comprising a die head, an extruder structure for extruding synthetic plastics material, the extruder structure being connected to the die head, means for feeding a filament to the die head so that it is coated with a tacky layer of synthetic plastics material, and means for applying discrete staple fibres to said tacky layer to form yarn, characterized in that each machine includes a false twister for consolidating the yarn, all the false twisters in the production facility rotating in the same direction.

Each machine preferably has a single die head, the material extruded by each of said extruder structures being fed exclusively to the single die head of the respective machine.

The production facility can include a plurality of sets of controls, the number of sets of controls being equal to the number of machines and each set of controls being unique to one of the machines.

Figure 2:
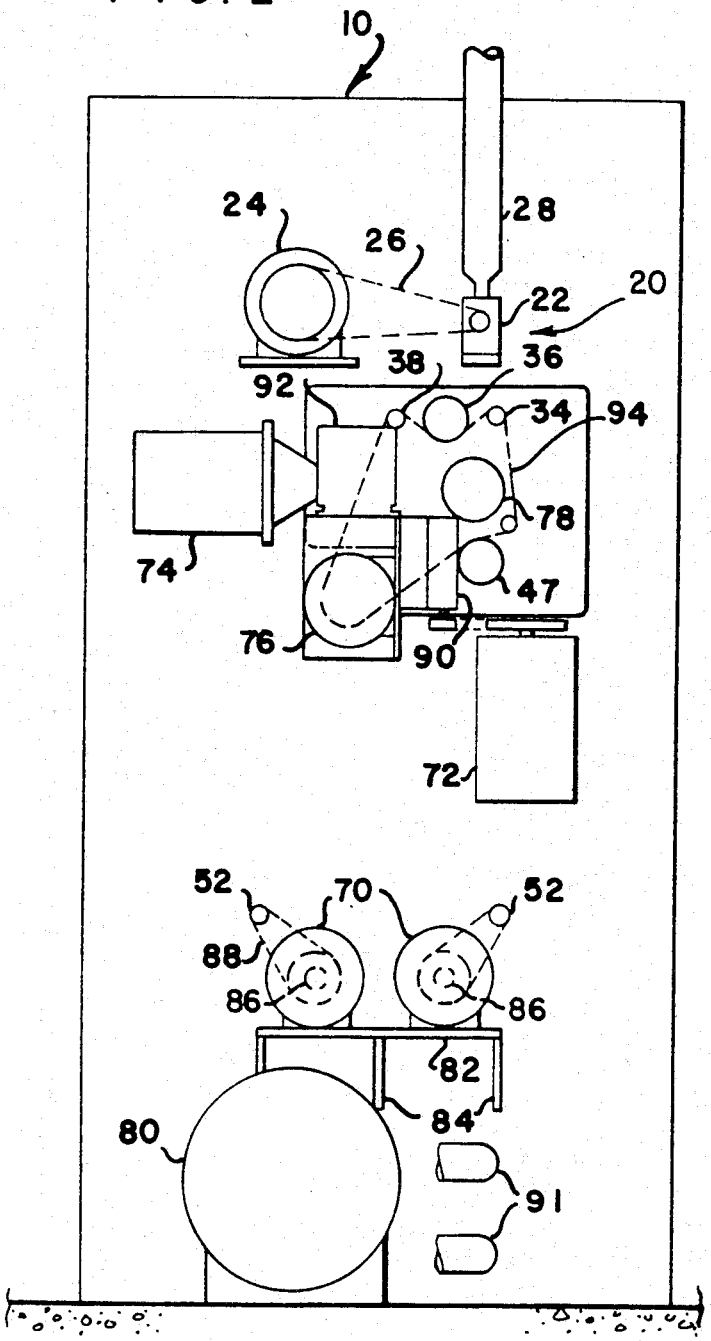
Figure 3:
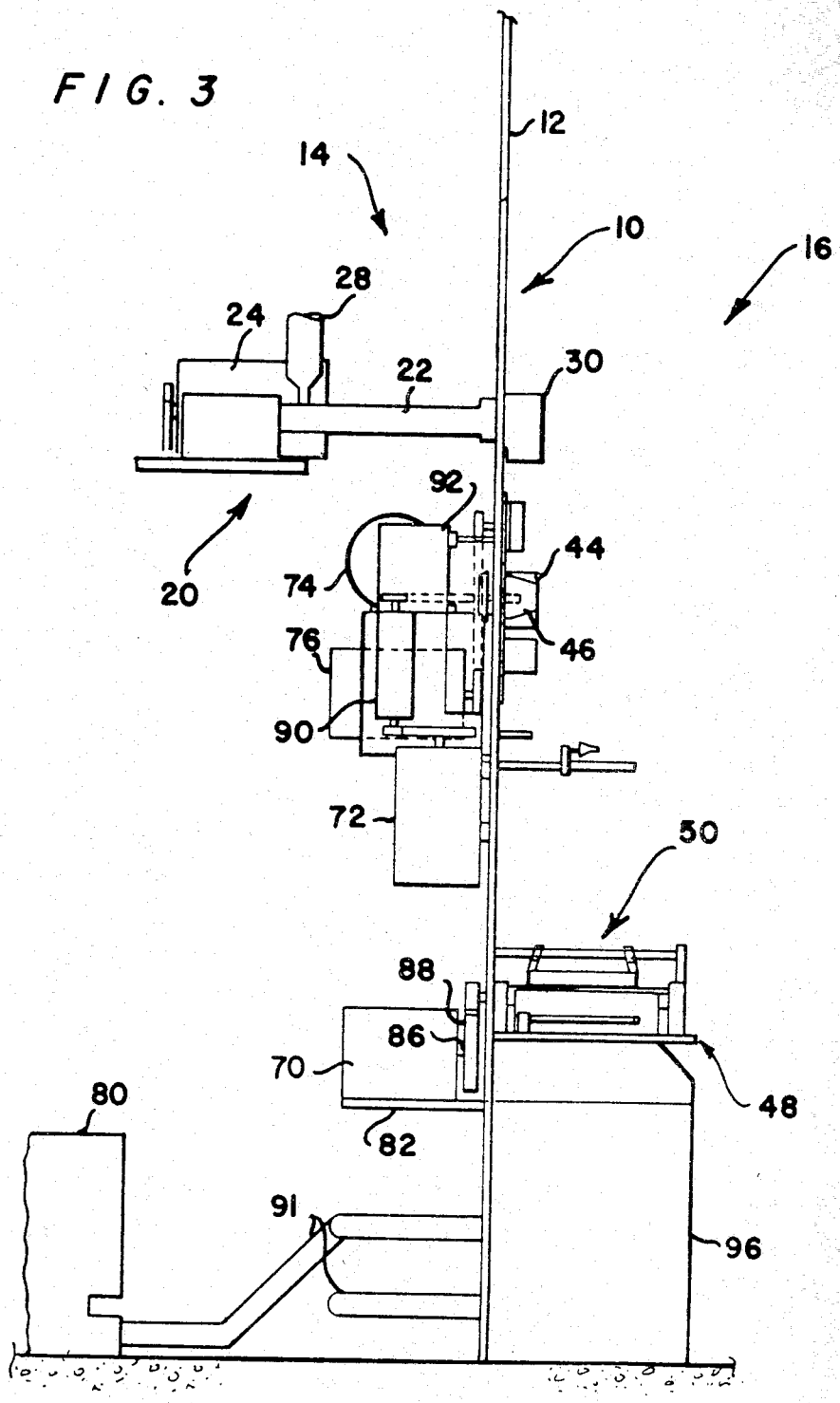

For a better understanding of the present invention, and to show how the same may be carried into effect, reference will now be made, by way of example, to the accompanying drawings in which:

FIG. 1 is a front elevation of a construction including a machine for producing yarn, FIG. 2 is a rear elevation of the construction of FIG. 1, FIG. 3 is a vertical section of the construction of FIG. 1 and 2.

The construction illustrated comprises a main plate 10 on which the majority of the parts of the yarn producing machine are directly or indirectly mounted. The plate 10 forms part of partitioning generally indicated at 12 (see FIG. 3) which divides the factory space into two separate regions designated 14 and 16 in FIG. 3. The region 14 is closed and preferably pressurised and the region 16 is the normal factory area in which the machine operators work. Because the region 14 is pressurised, there is minimal tendency for stray filaments resulting from the yarn producing process which occurs in the region 16, as will be described, to filter into the region 14.

To one side of the plate 10, as viewed in FIG. 1, there is a box 18 which is sealed-off from the region 16 and contains the electrical controls (not shown in detail). Such control knobs, buttons, switches and dials as must be available to the operator of the machine standing in the region 16 are provided on the front wall of the box 18. Those controls which are set on commissioning of the machine and require no further adjustment or manipulation by the operator of the machine are within the region 14.

In the region 14 there is an extruder structure generally indicated at 20. The extruder structure 20 includes an extruder barrel 22 and an a.c. electric motor 24 for driving the extruder screw (not shown) of the barrel 22 via a transmission chain or belt 26. A hopper 28 which contains pellets of the synthetic plastics material to be extruded extends upwardly from the infeed end of the barrel 22.

The barrel 22 passes through the plate 10 and leads to a die head 30 in the region 16.

Above the box 18 containing the electrical controls there is a compartment 32 with means therein for mounting two bobbins B. On each bobbin there is wound a filament F of synthetic plastics material. The bobbins are tip to tail creeled and, of course, only one is in use at a time. The front of the compartment 32 is closed by a vertically slidable glass door which seals the compartment 32 off from the region 16.

The filament F extends from that bobbin which is in use, upwardly over a guide (not shown) and then downwardly through an aperture 32.1 in the walling of the compartment 32 to reach the die head 30. The filament emerges through the lower face of the die head and extends downwardly therefrom. At the die head 30 the filament is coated with tacky synthetic plastics material which is forced into the die head 30 by the extruder screw in the barrel 22.

Three rotatable wheels 34, 36 and 38 are mounted side-by-side on the front face of the plate 10. If reference is made to FIG. 1 it will be noted that the plate 10 comprises a major part 10.1 and a minor part 10.2. The minor part 10.2 is mounted in an aperture of the major part 10.1. The reason for this is that the components of the machine which are mounted on the plate part 10.2 are those which are most likely to malfunction and/or require maintenance. The down time of the machine can be reduced simply by removing the plate part 10.2 and the components attached thereto and inserting another plate part 10.2 carrying new or recently maintained components. The removed plate part 10.2 can be taken away, with the relevant components still attached thereto, for subsequent attention.

Two sliver cans (not shown) are mounted in the region 16 and spaced from the plate 10. The cans are thus above and slightly behind an operator standing in front of the machine and facing the machine. The slivers from these cans extend upwardly over guides and then towards the plate 10 which they approach in the regions 40 (FIG. 1). The slivers (designated S below the regions 40) turn downwardly about guides (not shown) at the regions 40 and extend downwardly towards the wheels 34, 36 and 38. Adjacent the wheels 34 and 38 there are feed means designated 41 which constantly urge the slivers against the wheels 34 and 38.

Below the wheels 34, 36 and 38 there is a false twister unit 44 through which the composite yarn emerging from the wheels 34, 36 and 38 passes. Adjacent the false twister unit 44 there is a starter pulley 46, a main drive or Godet roller 47 and a free running roller 49. The starter pulley 46 is of tapered form.

The function of all the components mounted on the plate part 10.2 will be described in more detail hereinafter.

On a pedestal generally designated 48 adjacent the lower part of the plate 10, two winder mechanisms generally indicated at 50 are mounted. Each winder mechanism comprises a winder shaft 52, a winder head 54 and a cheese holder 56. Reference numerals 58, 60 and 62 designate thread guides which can be rotatable rollers or can be stationary bars.

A chute 64 (FIG. 1) slopes downwardly from beneath the die head 30, the lower end of the chute 64 being vertically above a down pipe 66. The down pipe 66 is in turn vertically above a receptacle 68. When the extruder screw is running but the filament F is not running, plastics material being extruded through the die head 30 slides down the chute 64 and falls down the pipe 66 into the receptacle 68 for subsequent removal.

A.C. motors with frequency controllers are shown at 70, 72, 74, 76, 78 and 80. These are two motors 70 which are mounted on a platform 82 protruding rearwardly from the plate 10 and strengthened by brackets 84. The output shaft 86 of each motor 70 drives the associated winder shaft 52 via belt pulleys and a belt 88.

The motor 72 drives the twister unit 44 via suitable belts and pulleys and a counter shaft 90.

The motor 74 is provided to feed the slivers of staple fibre and as such serves to drive the feed means 41 via a gearbox 92. The motor 76 is the main drive motor of the machine and this drives the wheels 34, 36, 38 and 47. In FIG. 2 a belt is shown diagrammatically at 94 and is entrained around a belt sprocket fast with the output shaft of the motor 76 and around sprockets mounted on the shafts which carry the wheels 34 etc.

The motor 78 is the starter motor and this drives the starter pulley 46.

Finally, the motor 80 is a suction motor and the reference numeral 91 designates vacuum pipes leading to the motor 80. The pipes 91 also communicate with filter tanks 96.

The wheels 34 and 38 each have a plurality of fine teeth on the periphery thereof and serve to tear the slivers S into a loose array of fibres. The hollow interior of wheel 36 is connected via the filter tanks 96 to the suction motor 80 and the wheel 36 has a plurality of apertures in the outer periphery thereof.

A suction aperture 95 is provided adjacent the outlet side of the false twister 44 and a thread breakage detector is shown at 97.

In use of the machine described, a filament F is drawn from the operative bobbin B and is fed manually through the die head 30. At this stage the extruder structure 20 is operative and the molten synthetic plastics material being extruded slides down the chute 64 eventually to reach the receptacle 68. The wheels 34, 36, 38 and 47 are all running at high speed and consequently the filament F cannot initially be fed through the apparatus by means of the main drive roller 47 without breaking. Instead, it is wound onto the smaller diameter end of the starter pulley 46, the linear speed of the filament F increasing as the filament winds itself progressively towards the larger diameter end of the starter pulley 46.

A starter yarn from an external source (not shown) is fed around the wheel 36, through the false twister unit 44 and then a number of times around the rollers 47 and 49 before being entrained over the guides 58, 60 and 62 to one of the winder mechanisms 50 (the right hand mechanism 50 is shown in use in FIG. 1) or to a suction gun which draws it off to waste. This yarn is strong enough to stand the shock on startup. Once the start-up thread is running at full speed to the winder mechanism and the filament F is running at full speed onto the starter pulley 46, the filament is carried over so that it is entrained by the moving start-up thread and then cut adjacent the pulley 46.

At a suitable moment during the start-up procedure the feed means 41 are activated to feed the slivers S against the fast rotating peripheries of the wheels 34 and 38. The teeth of the wheels tear the fibres off the slivers and throw them against the centre wheel 36. The centre wheel 36 is subjected to vacuum and this assists in holding the fibres against it from where they come into contact with the tacky filament F during its passage past the wheel 36. Some of the fibres adhere to the filament F. Once the newly formed yarn is properly entrained, the start-up thread is itself cut.

Once this procedure has been followed, there is now running through the machine a filament which is coated with molten synthetic plastics material and thus has a tacky surface to which fibres have been attached. The dwell time spent around the rollers 47 and 49 enables the tacky coating of the filament F to cool and solidify before the finished thread is wound by the mechanism 50.

As described the motors 74 and 76 respectively drive the feed means 41 and the wheels 34, 36, 38 and 47. There is no clutch between the motor 74 and the feed means 41 and no clutch between the motor 76 and the wheels 34, 36, 38 and 47. To facilite start-up, a foot operated switch can be provided. During a first stage of operation, the switch causes the motor 76 to be energised and this motor then runs up to full speed. During the second stage of operation, the motor 74 is energised and runs up to full speed while the motor 76 remains energised.

It will be understood that the wheels 34 and 38 supply fibres to both sides of the filament F which is consequently completely coated with such fibres.

Excess fibres which do not adhere to the filament are drawn through the apertures in the wheel 36 or through the suction aperture 95 into the filter tanks 96.

The a.c. motors can be replaced by d.c. motors with voltage controllers to enable their speeds to be adjusted. In other embodiments fixed speed or synchronous motor drives may be preferred.

It will be understood that there are bearings with seals where drive shafts pass through the plate 10 to the wheels 34, 36, 38 etc and also to the winder mechanisms 50. Similarly, there is a seal around the extruder barrel 22.

Transfer of fibres to one side of the filament takes place substantially directly from the wheel 34 and to the other side of the filament substantially indirectly, via the suction wheel 36, from the wheel 38.

A production facility for yarn comprises two or more machines of the form described above each with its extruder structure, motors etc on one side of the partitioning 12 and its wheels 34, 36 and 38 on the other side. There is an extruder structure 12 for each die head 30 so that the output from each extruder structure flow exclusively to the associated die head. Furthermore each machine has its own motors and its own controls so that each machine is adjustable totally independently of each other machine. The false twisters 44 all rotate in the same direction so that all the yarn produced by the facility is the same hand insofar as the direction of false twisting to which it was subjected is concerned.

I claim:

1. In a method of producing yarn in which a filament is coated with a tacky layer of synthetic plastic material and discrete staple fibers are then applied to the coated filament by machinery comprising some parts which necessarily have to be in a staple fiber containing environment and other parts which do not, the improvement which comprises partitioning the factory space in which said yarn is produced so as to provide a first region and a second region, maintaining a pressure differential across said partitioning, the pressure in said first region being lower than that in said second region, said parts which necessarily have to be in a staple fiber environment being in said first region and said other parts being in said second region, said partitioning minimizing transmission of fibers from said first region to said second region.

2. In a factory space including a machine for producing yarn, which machine comprises a die head, means for feeding a filament to said die head so that said filament is coated with a tacky layer of synthetic plastic material, means for applying discrete staple fibers to said tacky layer, and drive means for driving said staple fiber applying means, the improvement which comprises partitioning said factory space so that said drive means is on one side of said partitioning and said staple fiber applying means is on the other side of said partitioning, with said transmission means passing through said partitioning, said partitioning isolating a first region of said factory space containing said staple fiber applying means form a second region of said factory space containing said drive means, said second region being in the form of a closed room with pump means for raising the pressure in said second region to above the level of that in said first region.

3. A factory space as described in claim 2 wherein said drive means comprises a first electric motor and a second electric motor, and said means for applying discrete staple fibers comprises a wheel with teeth on the periphery thereof for tearing a sliver into discrete fibers, a suction wheel towards which, in use, said discrete fibers are drawn and about which said filament is entrained, and means for feeding said sliver to said tearing wheel, said first motor being directly connected to said tearing wheel and said suction wheel without the interposition of a clutch and said second motor being directly connected to said feed means without the interposing of a clutch.

* * * * *